US007915557B2

(12) United States Patent
Tanz

(10) Patent No.: US 7,915,557 B2
(45) Date of Patent: Mar. 29, 2011

(54) METHOD AND ARRANGEMENT FOR SYNCHRONIZING THE DISTRIBUTION INFORMATION OF SORTING STOCK WITH THE INFORMATION RELATING TO A SORTER ELEMENT LOADED WITH THIS SORTING STOCK

(75) Inventor: Torsten Tanz, Hilzingen (DE)

(73) Assignee: Siemens Aktiengesellschaft, Munich (DE)

( * ) Notice: Subject to any disclaimer, the term of this patent is extended or adjusted under 35 U.S.C. 154(b) by 37 days.

(21) Appl. No.: 12/383,780

(22) Filed: Mar. 26, 2009

(65) Prior Publication Data

US 2009/0242465 A1 Oct. 1, 2009

(30) Foreign Application Priority Data

Mar. 27, 2008 (DE) ..... 10 2008 015 912

(51) Int. Cl.
*B07C 5/00* (2006.01)

(52) U.S. Cl. ..... 209/583; 209/900

(58) Field of Classification Search ..... 209/552, 209/559, 583, 584, 900, 939
See application file for complete search history.

(56) References Cited

U.S. PATENT DOCUMENTS

| | | | | |
|---|---|---|---|---|
| 4,724,215 | A * | 2/1988 | Farber et al. | 435/287.3 |
| 5,734,742 | A * | 3/1998 | Asaeda et al. | 382/141 |
| 6,323,452 | B1 * | 11/2001 | Bonnet | 209/583 |
| 6,460,681 | B1 | 10/2002 | Coutant et al. | |
| 6,466,691 | B1 * | 10/2002 | Heuft | 382/142 |
| 6,954,225 | B2 * | 10/2005 | Chen | 348/207.99 |
| 7,270,227 | B2 * | 9/2007 | Bender et al. | 198/358 |
| 7,383,188 | B2 * | 6/2008 | Sacks et al. | 704/270 |
| 2002/0033884 | A1 * | 3/2002 | Schurr | 348/127 |
| 2007/0023193 | A1 * | 2/2007 | King | 166/387 |
| 2007/0177778 | A1 * | 8/2007 | Massaro | 382/128 |

FOREIGN PATENT DOCUMENTS

| | | | |
|---|---|---|---|
| DE | 202006018606 | U1 | 3/2007 |
| EP | 1200205 | B1 | 5/2002 |
| EP | 1351781 | B1 | 10/2003 |
| JP | 10300689 | A * | 11/1998 |
| WO | 0110574 | A1 | 2/2001 |

* cited by examiner

*Primary Examiner* — Joseph C Rodriguez

(57) ABSTRACT

A method and an arrangement for synchronizing distribution information of a sorting stock are provided. The sorting stock has information relating to a sorter element of a sorter loaded with the sorting stock. The sorter element is moved, together with a plurality of further sorter elements, on a path closed on itself past a laying-down station where the sorting stock is laid onto the support of this sorter element. The occupancy of the sorter element is recognized by an image comparison and the information known before the laying-down relating to the sorting stock is assigned unequivocally to the sorter element recognized as fed.

17 Claims, 2 Drawing Sheets

METHOD AND ARRANGEMENT FOR SYNCHRONIZING THE DISTRIBUTION INFORMATION OF SORTING STOCK WITH THE INFORMATION RELATING TO A SORTER ELEMENT LOADED WITH THIS SORTING STOCK

CROSS REFERENCE TO RELATED APPLICATIONS

This application claims priority of German Patent Application No. 10 2008 015 912.3 DE filed Mar. 27, 2008, which is incorporated by reference herein in its entirety.

FIELD OF INVENTION

The invention relates to a method and an arrangement for synchronizing the distribution information of sorting stock with information relating to a sorter element, loaded with this sorting stock, of a sorter, which sorter element is moved, together with a multiplicity of successive further sorter elements, along a path closed on itself past a laying-down station where the sorting stock is laid onto the support of this sorter element.

BACKGROUND OF THE INVENTION

Sorters of the generic type are mechanical plants for sorting piece goods, such as, for example, parcels, but also letters and flat packages or small packs, in order to deliver these to specific destinations by means of distribution information assigned to the piece goods. The sorters are part of a sorting and distribution system which can be used reliably only when the automatic identifiability of the sorting stock or of its distribution information is ensured; for only then can this sorting stock be delivered to a predetermined destination via technical devices.

The sorting and distribution systems for the sorting of piece goods consist in general of a horizontally or vertically revolving line-up of sorter elements on which the sorting stock is received. Thus, sorting systems of this type may consist of sorter carriages which are coupled to one another and which are designed in endless form as what are known as circular sorters on paths closed on themselves or else as linear sorters. Transverse-belt and tilting-tray sorters are formed by sorter carriages which are coupled to one another and are themselves equipped with tilting trays or transverse belts on which the piece goods are transported, lying on them, from a feed station to their destination. All sorting systems have in common the fact that the sorting stock is laid on the support (transverse belt, tilting tray, etc.) typical to each sorter and is transported, together with the sorter element (sorter carriage), to the destination where distribution takes place on the basis of the distribution information added to the sorting stock or sorter element.

The feeding of the sorter elements with the sorting stock takes place either manually or in an automated manner. In the case of automated feed, it is possible in a relatively simple way to detect information relating to the sorting stock laid automatically onto the sorter element and to effect synchronization between the information relating to the sorter element, for example a tilting-tray conveyor, and the distribution information (address) of the sorting stock. For the destination-compatible unloading of the sorter element, it is indispensible to know on which sorter element which article for which destination lies.

SUMMARY OF INVENTION

In the case of manual feeding, there has hitherto been no reliable and cost-effective method for synchronizing between the information known prior to the feed and relating to the sorting stock and the sorter element currently being fed. Particularly when the information relating to the sorting stock is generated by linguistic encoding and the generated information is to be assigned unequivocally to the sorter element currently occupied by the corresponding sorting stock, reliable methods have hitherto been lacking.

An object of the invention is to provide a cost-effective and highly reliable method and a corresponding arrangement for synchronizing sorting stock information and information relating to the sorter element during the manual laying of the sorting stock onto sorter elements of a generic sorter.

To achieve the object, it is proposed that, at least before and after the sorting stock is laid onto a sorter element, an image of the supporting region of each sorter element be prepared, that the occupancy of the sorter element by sorting stock be detected by means of an image comparison, and that the information known before the feed and relating to the sorting stock be assigned unequivocally to the sorter element recognized as being fed. The invention thus provides, even in the case of a manual laying-down operation, a cost-effective and reliable system for synchronizing sorting stock information and sorter elements by means of image capture and image analysis technology.

Preferably, there is provision whereby, for image comparison, an image of the support of the respective sorter element passing the laying-down station is prepared in each case in front of and behind the laying-down station. By means of an image comparison (delta analysis) of the image of one and the same sorter element in front of and after the laying-down station, it is possible unequivocally to establish whether a sorter element has been fed at this laying-down station. The information known before the feed and relating to the sorting stock can therefore be assigned unequivocally to the sorter element recognized as being currently fed.

This method also functions for minimal sorting stock thicknesses which cannot be detected by means of light barrier or light grating arrangements.

In addition to images of the support of the sorter element which are prepared in front of and behind the laying-down station, the image region of the laying-down station itself is incorporated into the image comparison.

It is considered beneficial that an image is prepared of a region which comprises the laying-down station and at least one sorter element positioned in front of and behind the laying-down station and is broken down for image comparison into subregions comparable with one another. Image comparison then takes place via the corresponding subregions of the overall image. The outlay in terms of hardware is lower for this second variant, but the outlay for evaluation is higher, while at the same time there is enhanced recognition reliability due to double delta observation.

It is particularly beneficial if, when the sorting stock is laid down manually, the information relating to the laid-down sorting stock is transferred by means of a linguistic input and is assigned to the respective sorter element. Using linguistic encoding in direct manual assignment to the sorter elements, the costs of the automatic sorter injections necessary hitherto for synchronization and the base area required for this purpose are saved.

A sorting and distribution system with an arrangement for synchronizing the information relating to sorting stock and the sorter element loaded with the sorting stock is characterized, in that at least one camera detecting the region of the laying-down station and the conveying element adjacent upstream is provided for preparing an image of the supporting region of the sorter element. The camera is in this case mounted above the sorter such that the supporting region and an article lying on it can be recognized clearly. By means of this arrangement, it is easily possible to image and to process even minimal sorting stock thicknesses which cannot be detected by means of light barrier or light grating arrangements.

It is likewise possible to provide for the sorter element positioned upstream and that positioned downstream of the laying-down station in each case a camera, by means of the images of which one and the same sorter element can be compared before and after the sorting stock is laid down, or else to provide in the region of the laying-down station a camera which detects the region of the laying-down station and the conveying element adjacent upstream and downstream and the image of which can then be broken down into at least two subimages.

The sorter may be part of a circular, linear, transverse-belt or tilting-tray sorter.

The invention affords a simple reliable system for synchronizing the information relating to sorting stock and the information relating to the sorter element, loaded with the sorting stock, of a generic sorter. The invention also advantageously makes it possible to determine and to monitor the laying-down performance of each individual operator. If the images of the sorter elements are stored after laying down has taken place in a positively identified laying-down operation, it is even possible to evince proof of whether the operator has placed the sorting stock correctly on the sorter element. It can consequently be checked whether the operator or the sorting machine was responsible for missorting.

BRIEF DESCRIPTION OF THE DRAWINGS

An exemplary embodiment of the invention is described below with reference to a diagrammatic drawing in which.

DETAILED DESCRIPTION OF INVENTION

Figure 1:
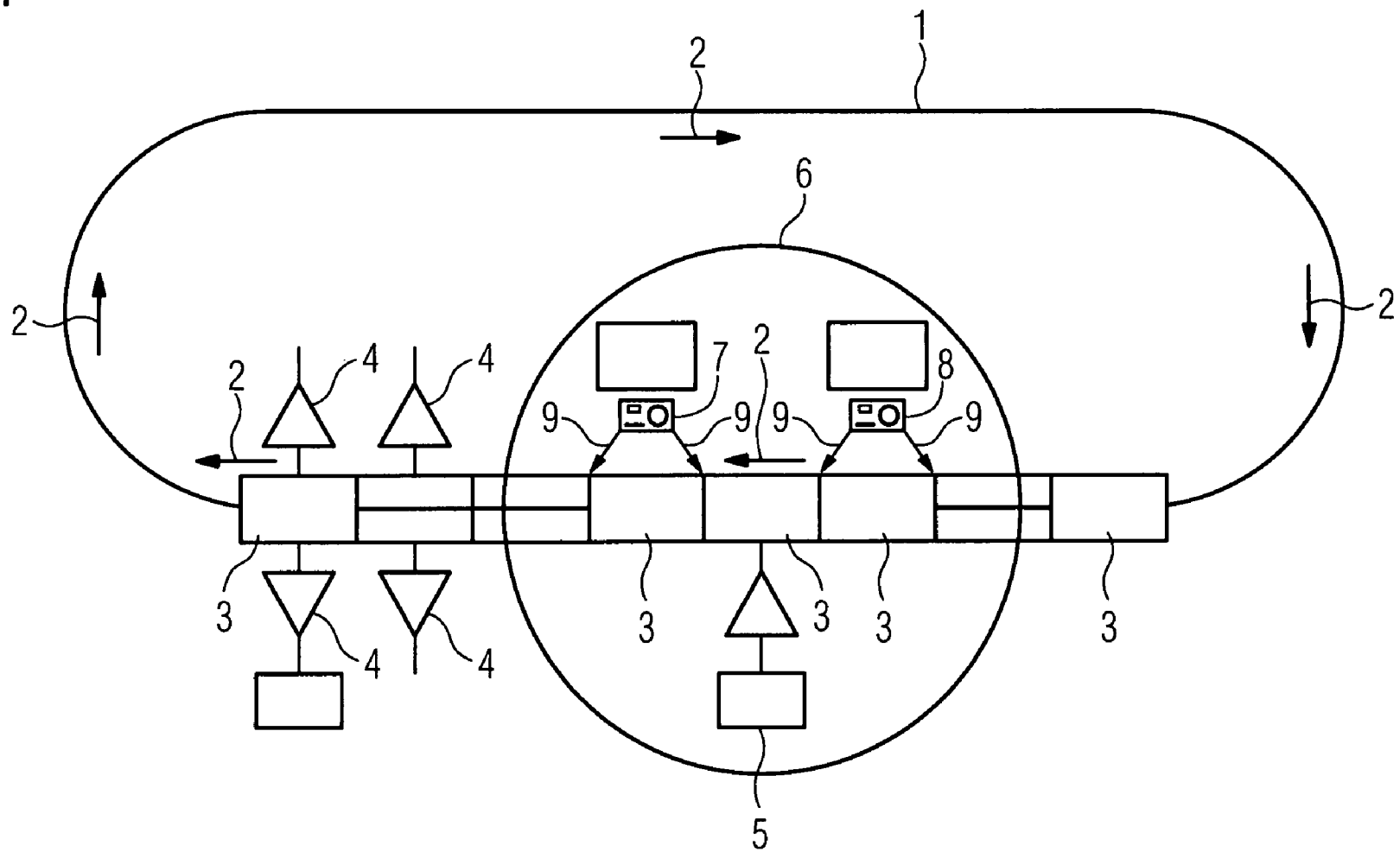
FIG. 1 shows a circular sorter in a top view with two cameras.

FIG. 1 illustrates a roughly diagrammatic illustration of a circular sorter. As can be seen, the circular sorter consists of sorter elements 3 which revolve endlessly in the direction of the arrow 2 along a path 1 closed on itself and of which only a few are illustrated symbolically. The destination or unloading stations are symbolized at 4 by triangles directed with the vertex away from the path of the circular sorter, and the laying-down station is symbolized at 5 by a triangle directed with the vertex toward the path 1 of the circular sorter. The two cameras 7 and 8 are illustrated in the circle 6 above the sorter elements 3 which are located on the right and left next to the laying-down station 5. As indicated by the arrows 9, the cameras 7, 8 detect the supporting region of the sorter elements 3, that is to say the camera 8 on the right in the drawing detects an empty sorter element, and the camera 7 arranged on the left next to the laying-down station 5 detects the same sorter element 3 which has in the meantime moved past the laying-down station 5 and been loaded there manually with sorting stock by an operator and which has in the meantime been moved further on into a position on the left next to the laying-down station. Simultaneously with the sorting stock being laid down onto the supporting region of the sorter element 3, the operator has by linguistic input entered the distribution information of the laid-down sorting stock into the computer and thus assigned the article to the sorter element 3 detected by the camera 7 and has synchronized the two with one another. Which sorter element is in question has been determined by an image comparison with the two camera images, with the result that it has been possible to establish that an empty sorter element 3, after passing the laying-down station 5, is then occupied. Since the change has taken place simultaneously with the linguistic input, it is certain which sorter element 3 has been occupied by the sorting stock.

Figure 2:
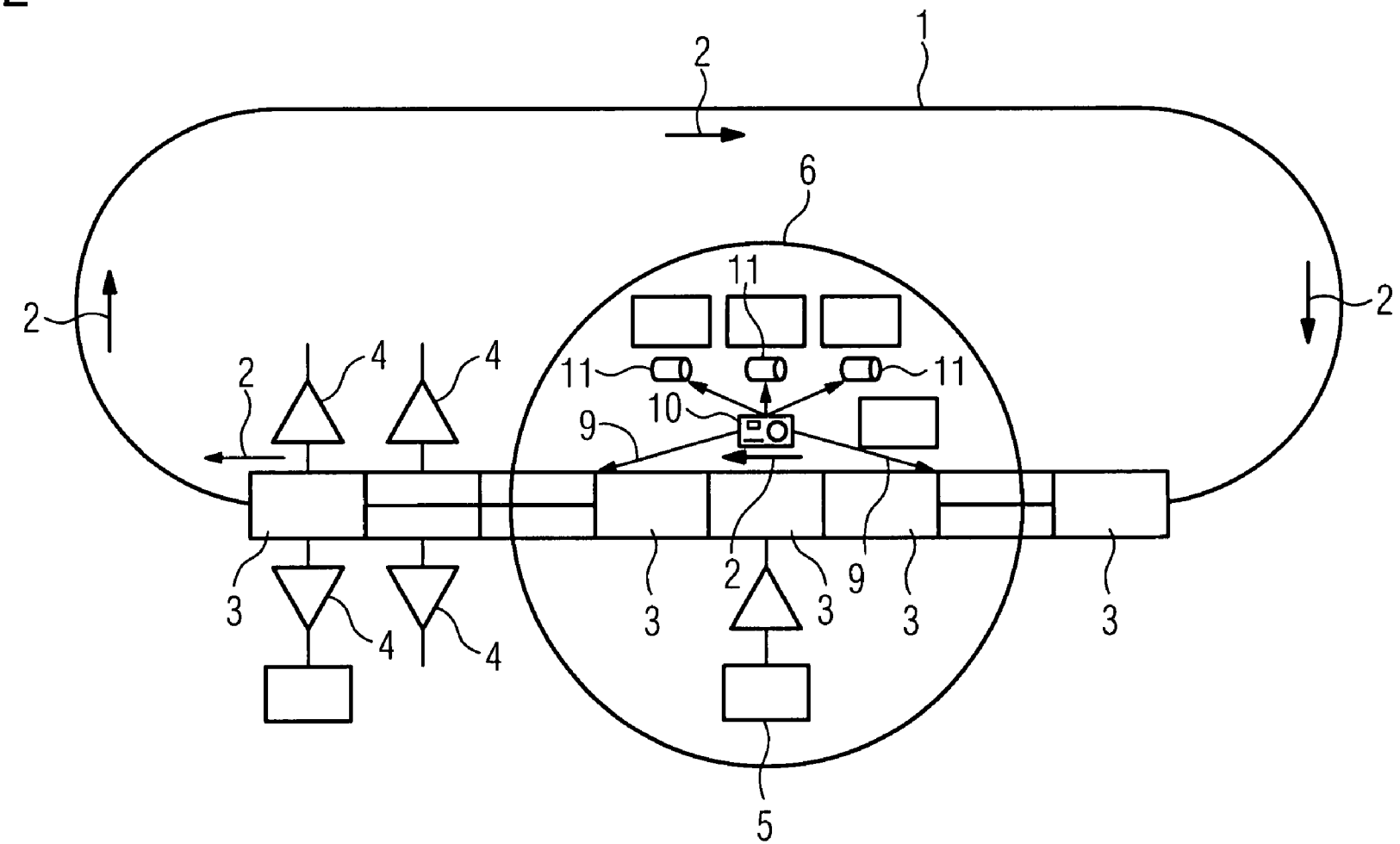
FIG. 2 shows a circular sorter in a top view with only one camera.

FIG. 2 illustrates the same sorter, identical parts being designated identically. The difference from the sorter according to FIG. 1 is that only one camera 10 is arranged in the region of the laying-down station 5. This camera 10 detects next to the laying-down station 5, as the arrows 9 symbolize, the two sorter elements 3 arranged on the right and on the left of the laying-down station 5. The captured image is broken down in the system into three subimages 11 which make it possible to recognize the change on the sorter element 3. In this case, too, it is possible by image comparison to determine which of the sorter elements has currently been loaded with sorting stock. Together with the linguistic input of the operator laying down the article, the sorting stock is then synchronized with the sorter element 3 and can be transported to the unloading location 4 provided. The invention thus ensures that it is always known which sorter element 3 has been loaded with which sorting stock.

The invention claimed is:

1. A method for synchronizing distribution information of a sorting stock with information relating to a sorter element of a sorter, the sorter element being loaded with the sorting stock, comprising:

moving the sorter element together with a plurality of successive further sorter elements on a path closed on itself past a laying-down station;

laying down the sorting stock onto a support of the sorter element;

preparing a first image of the support of the sorter element passing the laying-down station before the sorting stock is laid onto the sorter element;

preparing a second image of the support of the sorter element passing the laying-down station after the sorting stock is laid onto the sorter element;

comparing the first and second image of the sorter element;

recognizing an occupancy by the comparing of the first and second image of the sorter element;

assigning unequivocally the distribution information relating to the sorting stock known before the laying-down of the sorting stock to the sorter element which is recognized as fed with the sorting stock, transporting the sorting stock to an unloading station by the sorter element; and unloading the sorting stock at the unloading station where distribution takes place based upon the distribution information.

2. The method as claimed in claim 1, wherein the first image of the support of the sorter element is prepared in front of the laying-down station.

3. The method as claimed in claim 2, wherein the second image of the support of the sorter element is prepared behind the laying-down station.

4. The method as claimed in claim 2, wherein in addition to the first image and the second image, the image region of the laying-down station itself is incorporated into the image comparison.

5. The method as claimed in claim 1, wherein the second image of the support of the sorter element is prepared behind the laying-down station.

6. The method as claimed in claim 5, wherein in addition to the first image and the second image, the image region of the laying-down station itself is incorporated into the image comparison.

7. The method as claimed in claim 1, wherein in addition to the first image and the second image, the image region of the laying-down station itself is incorporated into the image comparison.

8. The method as claimed in claim 1, wherein an image is prepared of a region which comprises the laying-down station and at least one sorter element positioned in front of and behind the laying-down station, and wherein the image is broken down for image comparison into subregions comparable with one another.

9. The method as claimed in claim 1, wherein the laying down of the sorting stock is manually, and the information relating to the laid-down sorting stock is transferred by linguistic input and is assigned to the respective sorter element.

10. The method as claimed in claim 1, wherein the distribution information comprises an address assigned to the sorting stock.

11. A sorting and distribution system, comprising:

an arrangement for synchronizing distribution information of a sorting stock having with information relating to a sorter element which is loaded with the sorting stock;

a path which is closed on itself, the sorter element being moved together with a plurality of successive further sorter elements on the path;

a laying-down station, the sorter element and the plurality of successive further sorter elements being moved past the laying-down station and the sorting stock being laid onto the support of the sorter element;

a first camera configured to detect a region of the laying-down station and of the sorter element adjacent upstream and configured to prepare a first image of the support of the sorter element; and an unloading station, the sorting stock being transported to the unloading station by the sorter element, wherein the sorting stock is unloaded at the unloading station where distribution takes place based upon the distribution information, wherein the distribution information of the sorting stock, known before the sorting stock is laid onto the support of the sorter element, is assigned unequivocally to the sorter element which is recognized as fed with the sorting stock.

12. The sorting and distribution system as claimed in claim 11, further comprising:

a second camera configured to prepare a second image of the support of the sorter element positioned downstream of the laying-down station, wherein the first image and the second image are compared with one another.

13. The sorting and distribution system as claimed in claim 11, wherein the first camera is configured to detect the region of the laying-down station and of the sorter element adjacent upstream and downstream, wherein the first image of the first camera is broken down into at least two subimages.

14. The sorting and distribution system as claimed in claim 12, wherein the sorter element is part of a circular, linear, transverse-belt or tilting-tray sorter.

15. The sorting and distribution system as claimed in claim 13, wherein the sorter element is part of a circular, linear, transverse-belt or tilting-tray sorter.

16. The sorting and distribution system as claimed in claim 11, wherein the sorter element is part of a circular, linear, transverse-belt or tilting-tray sorter.

17. The sorting and distribution system as claimed in claim 11, wherein the distribution information comprises an address assigned to the sorting stock.

* * * * *